US011509054B2

(12) United States Patent
Ro et al.

(10) Patent No.: US 11,509,054 B2
(45) Date of Patent: Nov. 22, 2022

(54) DIPOLE ANTENNA FED BY PLANAR BALUN

(71) Applicant: ELECTRONICS AND TELECOMMUNICATIONS RESEARCH INSTITUTE, Daejeon (KR)

(72) Inventors: Haeng Sook Ro, Daejeon (KR); Kanghee Kim, Daejeon (KR); Gwangmoon Park, Daejeon (KR); Soo-Ho Sohn, Daejeon (KR); Ki Cheol Tae, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 197 days.

(21) Appl. No.: 17/132,195

(22) Filed: Dec. 23, 2020

(65) Prior Publication Data

US 2021/0280977 A1 Sep. 9, 2021

(30) Foreign Application Priority Data

Mar. 9, 2020 (KR) ..... 10-2020-0029111

(51) Int. Cl.

| | |
|---|---|
| ***H01Q 9/06*** | (2006.01) |
| ***H01Q 1/26*** | (2006.01) |
| ***H01Q 21/24*** | (2006.01) |
| ***H01Q 1/24*** | (2006.01) |
| ***H01Q 1/38*** | (2006.01) |

(52) U.S. Cl.

CPC ..... *H01Q 9/065* (2013.01); *H01Q 1/246* (2013.01); *H01Q 1/26* (2013.01); *H01Q 1/38* (2013.01); *H01Q 21/24* (2013.01)

(58) Field of Classification Search

CPC .. H01Q 9/06; H01Q 1/24; H01Q 1/26; H01Q 1/38; H01Q 21/24

USPC ..... 343/795

See application file for complete search history.

(56) References Cited

U.S. PATENT DOCUMENTS 7,746,284 B2 * 6/2010 Eom ..... H01Q 9/285 343/797
2005/0264464 A1 * 12/2005 Rankin ..... H01Q 9/22 343/893

FOREIGN PATENT DOCUMENTS

| | | | |
|---|---|---|---|
| KR | 10-2006-0036602 | A | 5/2006 |
| KR | 10-2011-0024584 | A | 3/2011 |
| KR | 10-1225581 | B1 | 1/2013 |
| KR | 10-1596922 | B1 | 2/2016 |
| WO | 99/21245 | A1 | 4/1999 |

* cited by examiner

*Primary Examiner* — Andrea Lindgren Baltzell
(74) *Attorney, Agent, or Firm* — LRK Patent Law Firm

(57) ABSTRACT

A dipole antenna fed by a planar balun includes a first radiation element and a second radiation element respectively corresponding to poles of the dipole antenna, at least one dipole support column configured to connect the first radiation element and the second radiation element and to fix a gap between the first radiation element and the second radiation element, a planar balun connected to the first radiation element and the second radiation element and configured to feed the first radiation element and the second radiation element, and a balun housing coupled to the dipole support column and enclosing the planar balun.

15 Claims, 4 Drawing Sheets

DIPOLE ANTENNA FED BY PLANAR BALUN

CROSS-REFERENCE TO RELATED APPLICATION(S)

This application claims the benefit of Korean Patent Application No. 10-2020-0029111 filed on Mar. 9, 2020, in the Korean Intellectual Property Office, the disclosure of which is incorporated herein by reference for all purposes.

BACKGROUND

1. Field of the Invention

One or more example embodiments relate to a dipole antenna fed by a planar balun, and more particularly, to a dipole antenna that may prevent distortion of a radiation pattern characteristic of the dipole antenna by reducing a volume of a balun housing that supports the dipole antenna and a planar balun.

2. Description of Related Art

A dipole antenna is one of antennas having a structure in which two straight conducting wires or radiation elements are arranged to be horizontally or vertically symmetric to each other and in which the two straight conducting wires are fed to have a phase difference of 180 degrees.

To use the dipole antenna as a broadband antenna, a radiation element and a planar balun for feeding the dipole antenna are used. Here, conventionally, when the planar balun and the radiation element are combined, a radiation pattern characteristic of the dipole antenna is distorted due to a large volume of an antenna support structure that supports the radiation element and the planar balun.

Thus, there is a demand for a technology for preventing a radiation pattern from being distorted by a balun housing when a radiation element constituting a dipole antenna is coupled to a planar balun.

SUMMARY

An aspect provides a dipole antenna manufactured by combining a broadband radiation element and a balun, which may minimize an influence by an antenna support structure that supports a radiation element and a planar balun while maintaining a shape of the dipole antenna without a change, and which may maintain an omnidirectional radiation characteristic of the dipole antenna within a broadband operating frequency range.

Also, another aspect provides a dipole antenna which may maintain a gap between radiation elements by adding a dipole support column between the radiation elements, and which may fix a planar balun by coupling the dipole support column and a balun housing.

According to an aspect, there is provided a dipole antenna including a first radiation element and a second radiation element respectively corresponding to poles of the dipole antenna, at least one dipole support column configured to connect the first radiation element and the second radiation element and to fix a gap between the first radiation element and the second radiation element, a planar balun connected to the first radiation element and the second radiation element and configured to supply balanced signals to the first radiation element and the second radiation element or to synthesize balanced signals received from the first radiation element and the second radiation element, and a balun housing coupled to the dipole support column and enclosing the planar balun.

The first radiation element and the second radiation element may be arranged to be vertically or horizontally symmetrical to each other.

The first radiation element and the second radiation element may be each formed of a metal material.

The first radiation element and the second radiation element may each include a groove for coupling to the dipole support column, and the groove of the first radiation element and the groove of the second radiation element may be formed to face each other. The dipole support column may be inserted into the groove of the first radiation element and the groove of the second radiation element, to connect the first radiation element and the second radiation element.

The planar balun may be configured to provide balanced signals with a phase difference of 180 degrees to the first radiation element and the second radiation element.

The balun housing may be formed of a dielectric material.

The balun housing may include a plurality of fixing holes to couple the balun housing to the planar balun.

The balun housing may include an input/output terminal connected to a transmitter or a receiver connected to the dipole antenna.

The dipole antenna may further include a metal wire connected to each of the first radiation element and the second radiation element and configured to transfer a balanced signal between the planar balun and each of the first radiation element and the second radiation element.

The planar balun may be connected to the metal wire and may be configured to supply balanced signals to the first radiation element and the second radiation element via the metal wire or to synthesize balanced signals received from the first radiation element and the second radiation element.

According to another aspect, there is provided a dipole antenna including a printed circuit board (PCB) substrate including at least one patch element, a planar balun connected to a metal wire on the PCB substrate and configured to supply a balanced signal to the PCB substrate via the metal wire or to synthesize balanced signals received from the PCB substrate, the metal wire inserted into the PCB substrate, connected to the planar balun and configured to transfer a balanced signal between the PCB substrate and the planar balun, and a balun housing coupled to the PCB substrate and enclosing the planar balun.

The patch element may have a shape of a bowtie, and a plurality of patch elements may be symmetrical.

The planar balun may be configured to provide balanced signals with a phase difference of 180 degrees to the patch element.

The balun housing may be formed of a dielectric material.

The balun housing may include a plurality of fixing holes to couple the balun housing to the planar balun.

The balun housing may include an input/output terminal connected to a transmitter or a receiver connected to the dipole antenna.

Additional aspects of example embodiments will be set forth in part in the description which follows and, in part, will be apparent from the description, or may be learned by practice of the disclosure.

According to example embodiments, a dipole antenna manufactured by combining a broadband radiation element and a balun may minimize an influence by an antenna support structure that supports a radiation element and a planar balun while maintaining a shape of the dipole antenna without a change, and may maintain an omnidirectional radiation characteristic of the dipole antenna within a broadband operating frequency range.

Also, according to example embodiments, a dipole antenna may maintain a gap between radiation elements by adding a dipole support column between the radiation elements, and may fix a planar balun by coupling the dipole support column and a balun housing.

BRIEF DESCRIPTION OF THE DRAWINGS

These and/or other aspects, features, and advantages of the invention will become apparent and more readily appreciated from the following description of example embodiments, taken in conjunction with the accompanying drawings of which.

DETAILED DESCRIPTION

Figure 1A:
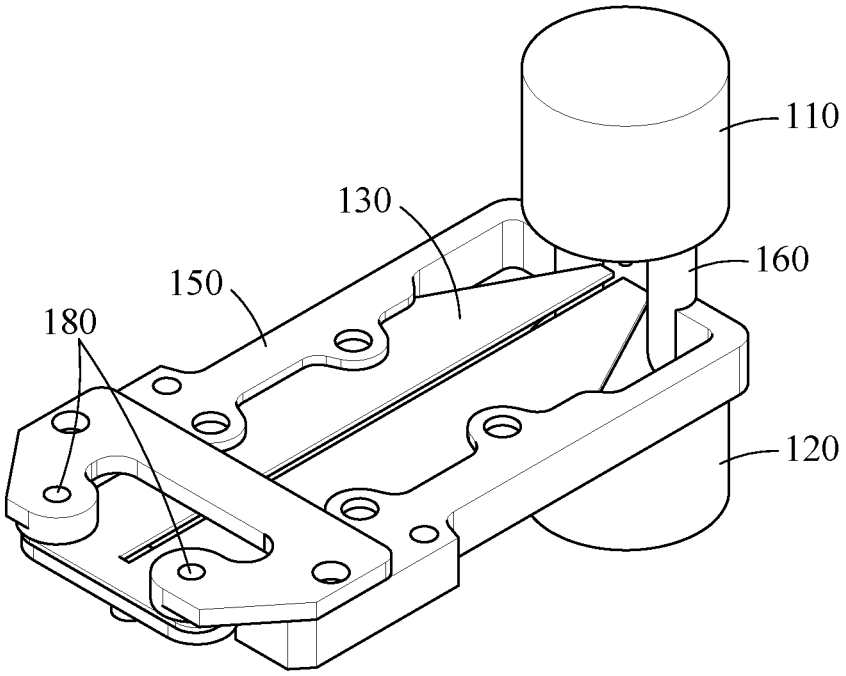
FIG. 1A is a perspective view illustrating an example of a dipole antenna according to an example embodiment.

Hereinafter, example embodiments will be described in detail with reference to the accompanying drawings. Various modifications may be made to example embodiments. However, it should be understood that these embodiments are not construed as limited to the illustrated forms and include all changes, equivalents or alternatives within the idea and the technical scope of this disclosure.

The terminology used herein is for the purpose of describing particular example embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise specified, all the terms including technical terms and scientific terms used herein have the same meanings commonly understandable to those skilled in the art to which the present invention pertains. In addition, the terms defined in generally used dictionaries are additionally interpreted to have meanings corresponding to relating scientific literatures and contents disclosed now, and are not interpreted either ideally or very formally unless defined otherwise.

When describing the example embodiments with reference to the accompanying drawings, like reference numerals refer to like constituent elements and a repeated description related thereto will be omitted. In the description of example embodiments, detailed description of well-known related structures or functions will be omitted when it is deemed that such description will cause ambiguous interpretation of the present disclosure.

FIG. 1A is a perspective view illustrating an example of a dipole antenna according to an example embodiment.

As shown in FIG. 1A, a first radiation element 110 and a second radiation element 120 of the dipole antenna are coupled to a planar balun 130 for feeding the dipole antenna. The dipole antenna may refer to an antenna with two poles that are arranged to be vertically or horizontally symmetrical to each other. The dipole antenna may be fed to have a phase difference of 180 degrees between the two poles.

Referring to FIG. 1A, the first radiation element 110 and the second radiation element 120 may respectively correspond to two poles of the dipole antenna and may be arranged to be vertically or horizontally symmetrical to each other. A radiation element may include a conducting wire and may perform omnidirectional radiation. Also, the first radiation element 110 and the second radiation element 120 may be formed of metal materials.

Referring to FIG. 1A, the first radiation element 110 and the second radiation element 120 may each have a cylindrical shape, or other shapes, for example, a conical shape or a flat rectangular shape. Shapes of the first radiation element 110 and the second radiation element 120 are not limited to the above examples. The shapes of the first radiation element 110 and the second radiation element 120 may be symmetrical to each other.

Referring to FIG. 1A, the first radiation element 110 and the second radiation element 120 may be disposed to form an angle of 180 degrees therebetween. However, since the shapes of the first radiation element 110 and the second radiation element 120 are vertically or horizontally symmetrical to each other, the first radiation element 110 and the second radiation element 120 may have a shape of "Y" or may form an angle other than 180 degrees therebetween. Also, the first radiation element 110 and the second radiation element 120 may be implemented to be bendable.

Referring to FIG. 1A, at least one dipole support column 160 may be added between the first radiation element 110 and the second radiation element 120. The dipole support column 160 may connect the first radiation element 110 and the second radiation element 120. In an example, the dipole support column 160 may have a cylindrical shape, or other shapes, for example, a triangular shape or a rectangular shape. However, a shape of the dipole support column 160 is not limited the above examples.

The first radiation element 110 and the second radiation element 120 may each include a groove for coupling to the dipole support column 160. The groove of the first radiation element 110 and the groove of the second radiation element 120 may be formed to face each other. The dipole support column 160 may be inserted into the groove of the first radiation element 110 and the groove of the second radiation element 120 and may be coupled to the first radiation element 110 and the second radiation element 120.

The dipole support column 160 may maintain a gap between the first radiation element 110 and the second radiation element 120 and may fix the first radiation element 110 and the second radiation element 120. Also, the dipole support column 160 may be coupled to a balun housing 150 that supports the planar balun 130, so that the first radiation element 110 and the second radiation element 120 may be stably fed through the planar balun 130.

Referring to FIG. 1A, the first radiation element 110 and the second radiation element 120 may be connected to the planar balun 130 that provides balanced signals with a phase difference of 180 degrees between the first radiation element 110 and the second radiation element 120. For example, the planar balun 130 may be connected to a metal wire 140 connected to each of the first radiation element 110 and the second radiation element 120.

For example, the planar balun 130 may supply balanced signals to the first radiation element 110 and the second radiation element 120 of the dipole antenna via metal wires 140, or may synthesize balanced signals received from the first radiation element 110 and the second radiation element 120. In other words, a feeding operation performed by the planar balun 130 may correspond to an operation of supplying a balanced signal.

The dipole antenna may be connected to a transmitter and a receiver that perform a wireless communication through a coaxial line. When the dipole antenna is connected to the transmitter, the planar balun 130 may supply balanced signals to the first radiation element 110 and the second radiation element 120. When the dipole antenna is connected to the receiver, the planar balun 130 may receive balanced signals from the first radiation element 110 and the second radiation element 120.

Also, the planar balun 130 may perform impedance matching. When a difference in impedance between the dipole antenna and the transmitter or the receiver connected to the dipole antenna increases, a balanced signal may not be properly transferred between the dipole antenna and the transmitter or the receiver.

The impedance matching may indicate that when there is a difference in impedance between a dipole antenna and a transmitter or a receiver connected to the dipole antenna, impedance transformation between the dipole antenna and the transmitter or the receiver is gradually performed so that signals are properly transmitted. Thus, the impedance transformation may be gradually performed by inserting a planar balun between the dipole antenna and the transmitter or the receiver, to facilitate transmission of a balanced signal.

The planar balun 130 may convert an unbalanced signal received from the coaxial line that connects the dipole antenna to the transmitter or the receiver into a balanced signal.

The planar balun 130 may be located between the first radiation element 110 and the second radiation element 120. Also, the first radiation element 110 and the second radiation element 120 may be symmetrical to each other based on the planar balun 130.

Referring to FIG. 1A, the planar balun 130 may be located between the first radiation element 110 and the second radiation element 120 located on a straight line. Also, the planar balun 130 may be perpendicular to the first radiation element 110 and the second radiation element 120. However, an angle between the first radiation element 110 and the second radiation element 120 may vary.

In an example, to use the dipole antenna for a broadband and an ultra high frequency (UHF)/super high frequency (SHF) band of high frequencies, a planar balun 130 implemented on a printed circuit board (PCB) may be used. The planar balun 130 may include, for example, a microstrip (MS)-to-coplanar waveguide (CPW) balun, an MS-to-coplanar stripline (CPS) balun, or a coplanar waveguide (CPW)-to-CPS balun.

For stable feeding through the planar balun 130, the first radiation element 110, the second radiation element 120, and the planar balun 130 may need to be fixed. The balun housing 150 may enclose the planar balun 130 and may be coupled to the dipole support column 160 connected to the first radiation element 110 and the second radiation element 120, to fix the planar balun 130.

The balun housing 150 may protect the planar balun 130 and may support the planar balun 130 to prevent the planar balun 130 and the metal wire 140 from being disconnected due to an external factor. Also, the balun housing 150 may be formed of a dielectric material.

Referring to FIG. 1A, the balun housing 150 and the planar balun 130 may be coupled through a plurality of fixing holes 180 included in the balun housing 150. Also, the balun housing 150 may have a shape enclosing edges of the planar balun 130, to protect the planar balun 130.

Unlike an antenna support structure according to a related art, the balun housing 150 may support the planar balun 130 instead of supporting the first radiation element 110 and the second radiation element 120, and may be coupled and fixed to the dipole support column 160 located between the first radiation element 110 and the second radiation element 120. Thus, the balun housing 150 may have a volume less than that of the antenna support structure according to the related art, and accordingly it is possible to prevent a radiation pattern of the dipole antenna from being distorted due to an antenna support structure.

Figure 1B:
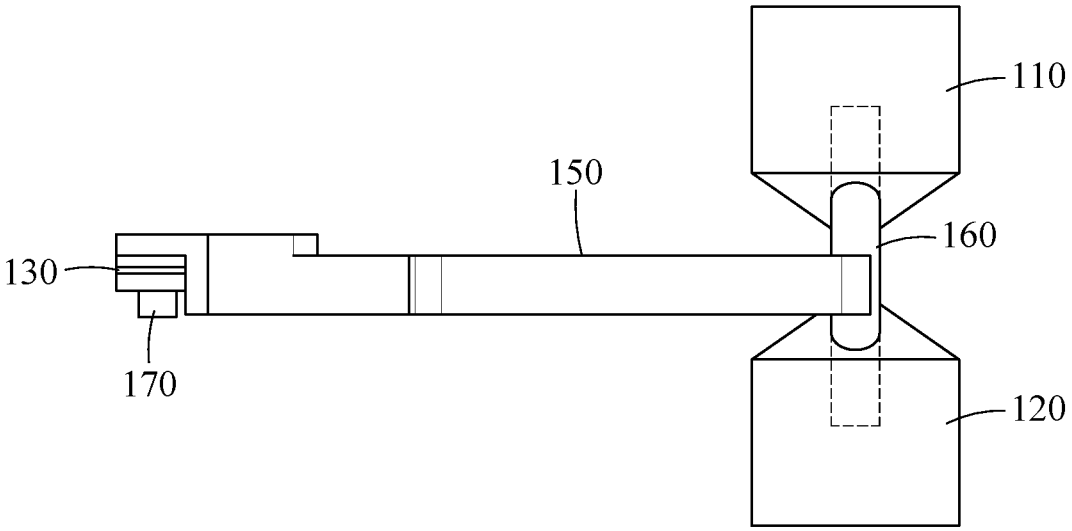
FIG. 1B is a side view illustrating the dipole antenna of FIG. 1A.

FIG. 1B is a side view illustrating the dipole antenna of FIG. 1A.

FIG. 1B illustrates a side of the dipole antenna in which the first radiation element 110 and the second radiation element 120 are coupled to the planar balun 130 for feeding the dipole antenna. In FIG. 1B, a dashed line in each of the first radiation element 110 and the second radiation element 120 represents a groove of each of the first radiation element 110 and the second radiation element 120 into which the dipole support column 160 is inserted.

Referring to FIG. 1B, the dipole support column 160 may be located between the first radiation element 110 and the second radiation element 120, may connect the first radiation element 110 and the second radiation element 120, and may be coupled to the first radiation element 110 and the second radiation element 120 through the grooves of the first radiation element 110 and the second radiation element 120.

Also, the dipole support column 160 may be vertically coupled to the balun housing 150. Similarly to FIG. 1A, the first radiation element 110 and the second radiation element 120 may be disposed on a straight line and an angle between the first radiation element 110 and the second radiation element 120 may be 180 degrees.

Referring to FIG. 1B, the first radiation element 110, the second radiation element 120 and the balun housing 150 may be coupled to form a shape of "T". In other words, a plane including the balun housing 150 and the planar balun 130 may be perpendicular to a line segment connecting a center of a bottom surface of the first radiation element 110 and a center of a top surface of the first radiation element 120. A plane including the balun housing 150 and the planar balun 130 may be perpendicular to a line segment connecting a center of a bottom surface of the second radiation element 110 and a center of a top surface of the second radiation element 120.

However, the angle between the first radiation element 110 and the second radiation element 120 may vary, as described above, and accordingly the first radiation element 110 and the second radiation element 120 may form an angle other than 180 degrees. Also, the first radiation element 110 and the second radiation element 120 may be implemented to be bendable. For example, the first radiation element 110, the second radiation element 120 and the balun housing 150 may be coupled to form a shape of "Y".

The planar balun 130 may be inserted into a central portion of the balun housing 150 and may be coupled to the balun housing 150. The balun housing 150 may include an input/output terminal 170, in addition to the fixing holes 180, for coupling to the planar balun 130. The input/output terminal 170 may be located on an opposite side to a portion in which the balun housing 150 is coupled to the dipole support column 160. The input/output terminal 170 may be connected to the transmitter or the receiver via the coaxial line, to transfer radio waves to the transmitter or the receiver.

The balun housing 150 and the planar balun 130 may be coupled through the fixing holes 180 and the input/output terminal 170. For example, the balun housing 150 and the planar balun 130 may be fixed with a coupling tool such as a screw passing through a fixing hole 180 of the balun housing 150, the planar balun 130, and the input/output terminal 170.

Figure 1C:
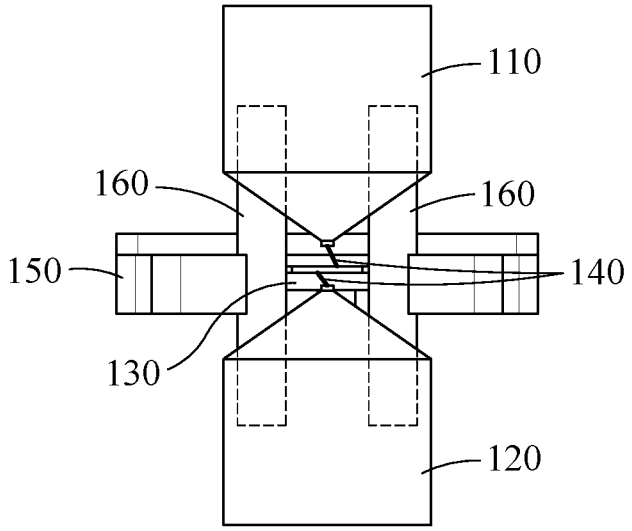
FIG. 1C is a front view illustrating the dipole antenna of FIG. 1A.

FIG. 1C is a front view illustrating the dipole antenna of FIG. 1A.

FIG. 1C illustrates a front side of the dipole antenna in which the first radiation element 110 and the second radiation element 120 are coupled to the planar balun 130 for feeding the dipole antenna. Referring to FIG. 1C, two dipole support columns 160 connecting the first radiation element 110 and the second radiation element 120 are disposed.

The first radiation element 110 and the second radiation element 120 may be fixed at a predetermined interval. The metal wire 140 may be connected to each of the first radiation element 110 and the second radiation element 120. The metal wire 140 may transfer a balanced signal received from the planar balun 130 to each of the first radiation element 110 and the second radiation element 120. Referring to FIG. 1C, the planar balun 130 may be connected to the metal wire 140. Thus, the planar balun 130 may feed the first radiation element 110 and the second radiation element 120 through the metal wire 140.

Referring to FIG. 1C, the balun housing 150 may be vertically coupled to the two dipole support columns 160. The balun housing 150 may be perpendicular to a direction vector corresponding to a line segment connecting a bottom surface and a top surface of the dipole support column 160 connected to the metal wire 140. The dipole support columns 160 and the balun housing 150 may fix a connection of the planar balun 130 and the first radiation element 110 and the second radiation element 120.

Figure 2A:
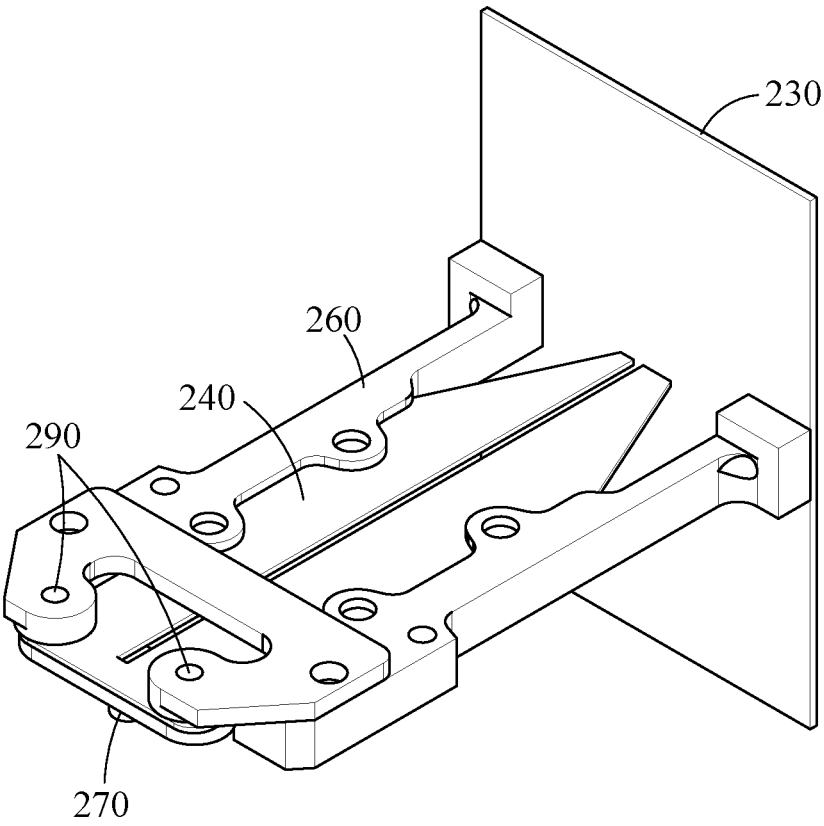
FIG. 2A is a perspective view illustrating another example of a dipole antenna according to an example embodiment.

FIG. 2A is a perspective view illustrating another example of a dipole antenna according to an example embodiment.

The dipole antenna of FIG. 2A may be a planar dipole antenna. Referring to FIG. 2A, the dipole antenna includes a planar PCB substrate 230 including patch elements, a planar balun 240 for feeding the PCB substrate 230, and a balun housing 260 configured to fix the planar balun 240.

The dipole antenna of FIG. 2A may not have two poles, unlike the dipole antenna of FIG. 1A, and patch elements 210 and 220 may be printed on the PCB substrate. The PCB substrate 230 may include the two patch elements 210 and 220. The patch elements 210 and 220 may perform the same function as a radiation element. However, since the radiation element has a three-dimensional shape and the patch elements 210 and 220 have planar shapes, a radiation pattern may change. Thus, similarly to the radiation element, the patch elements 210 and 220 may receive balanced signals from the planar balun 240 or may transfer the received balanced signals to the planar balun 240.

The balun housing 260 may enclose the planar balun 240 and may be coupled to the PCB substrate 230, to fix the planar balun 240. The balun housing 260 may be coupled to the PCB substrate 230 and may be perpendicular to the PCB substrate 230. For example, a plane including the balun housing 260 and the planar balun 240 may be perpendicular to a plane including the PCB substrate 230.

The balun housing 260 may protect the planar balun 240, and may support the planar balun 240 to prevent the planar balun 240 and a metal wire 250 from being disconnected due to an external factor. Also, the balun housing 260 may be formed of a dielectric material.

Referring to FIG. 2A, the balun housing 260 and the planar balun 240 may be coupled through a plurality of fixing holes 290 included in the balun housing 260. Also, the balun housing 260 may have a shape enclosing edges of the planar balun 240, to protect the planar balun 240.

Figure 2B:
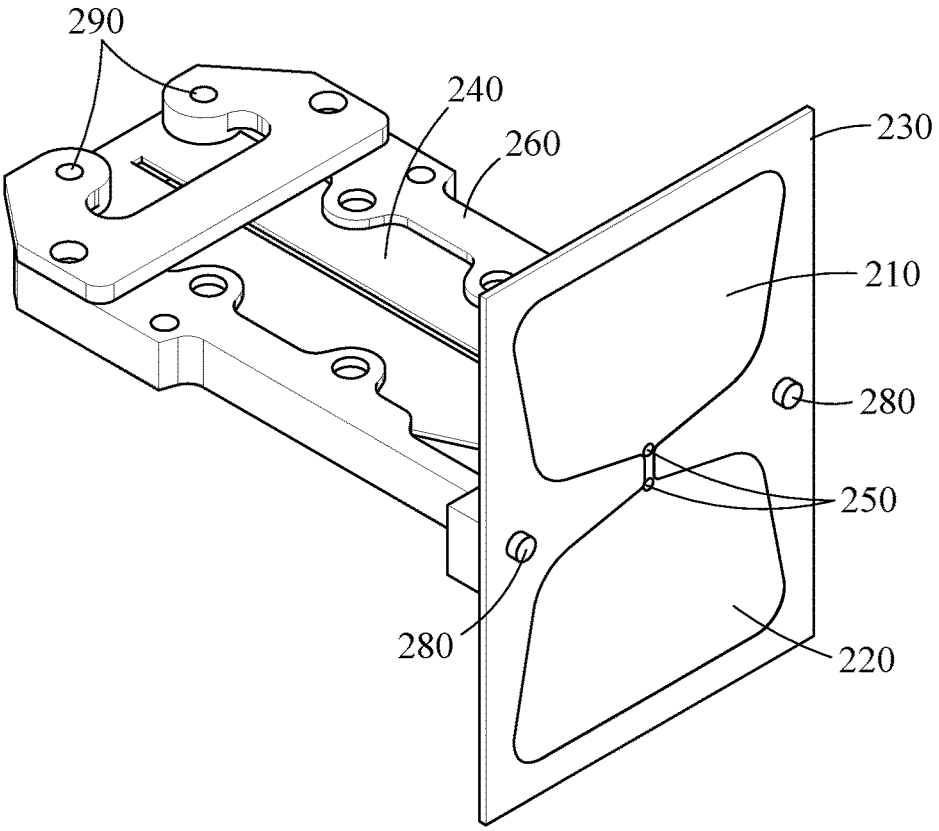
FIG. 2B is a side view illustrating the dipole antenna of FIG. 2A.

FIG. 2B is a side view illustrating the dipole antenna of FIG. 2A.

The PCB substrate 230 includes the two patch elements 210 and 220. The patch elements 210 and 220 may be vertically or horizontally symmetrical to each other. As shown in FIG. 2B, the patch elements 210 and 220 may have a shape of a bowtie. The patch elements 210 and 220 may have various dipole shapes, for example, a fan shape, to function as a broadband element.

Referring to FIG. 2B, the PCB substrate 230 may include the metal wire 250 connected to the planar balun 240 for feeding, and one or more coupling holes 280 coupled to the balun housing 260. The coupling holes 280 may be located between the patch elements 210 and 220.

The balun housing 260 may be coupled to the PCB substrate 230 through the coupling holes 280, to fix the PCB substrate 230 and the planar balun 240. In an example, the PCB substrate 230 and the balun housing 260 may be coupled through a screw inserted into the balun housing 260 and the coupling holes 280.

The planar balun 240 may be connected to a central portion of the PCB substrate 230. Specifically, the planar balun 240 may be connected to the metal wire 250 inserted through a hole in the central portion of the PCB substrate 230. The planar balun 240 may be perpendicular to the PCB substrate 230. Specifically, the patch elements 210 and 220 may be coupled to the planar balun 240 through the metal wire 250 inserted between the patch elements 210 and 220. Also, the planar balun 240 may supply balanced signals with a phase difference of 180 degrees to the patch elements 210 and 220, or may synthesize balanced signals received from the patch elements 210 and 220.

Specifically, when the dipole antenna is connected to the transmitter, the planar balun 240 may supply balanced signals to the patch elements 210 and 220. When the dipole antenna is connected to the receiver, the planar balun 240 may receive balanced signals from the patch elements 210 and 220 and may synthesize the balanced signals. Also, the planar balun 240 may perform impedance matching between the dipole antenna and the transmitter or the receiver connected to the dipole antenna.

The metal wire 250 may be located between the patch elements 210 and 220 included in the PCB substrate 230. The patch elements 210 and 220 may be symmetrical to each other based on the metal wire 250.

Unlike the antenna support structure according to the related art, the balun housing 260 may support the planar balun 240 instead of supporting the patch elements 210 and 220, and may be fixed through the coupling holes 280 included in the PCB substrate 230. Thus, the balun housing

260 may have a volume less than that of the antenna support structure according to the related art, and accordingly it is possible to prevent a radiation pattern of the dipole antenna from being distorted due to an antenna support structure.

Figure 2C:
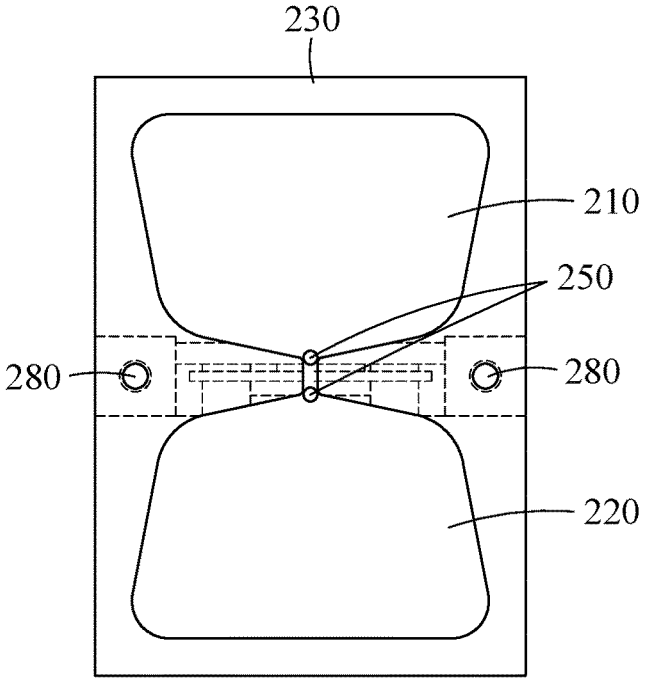
FIG. 2C is a front view illustrating the dipole antenna of FIG. 2A.

FIG. 2C is a front view illustrating the dipole antenna of FIG. 2A.

FIG. 2C illustrates a front side of the PCB substrate 230 connected to the planar balun 240 and the balun housing 260. Referring to FIG. 2C, the patch elements 210 and 220 having a shape of a bowtie may be symmetrical to each other. The metal wire 250 may be inserted between the patch elements 210 and 220, and may be connected to the planar balun 240.

The coupling holes 280 may correspond to points at which the PCB substrate 230 is coupled to the balun housing 260 that is perpendicular to the PCB substrate 230. Accordingly, referring to FIG. 2C, the coupling holes 280 may be located on both ends of a line segment formed by contacting the PCB substrate 230 and a plane including the balun housing 260 and the planar balun 240.

Figure 3A:
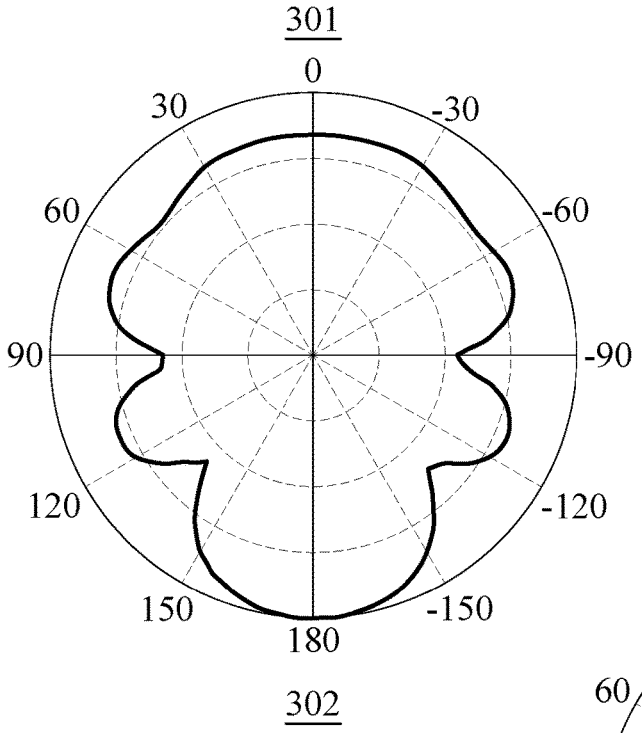
FIG. 3A (RELATED ART)
FIG. 3A is a graph illustrating a simulation result of a radiation pattern of a dipole antenna according to a related art.
Figure 3B:
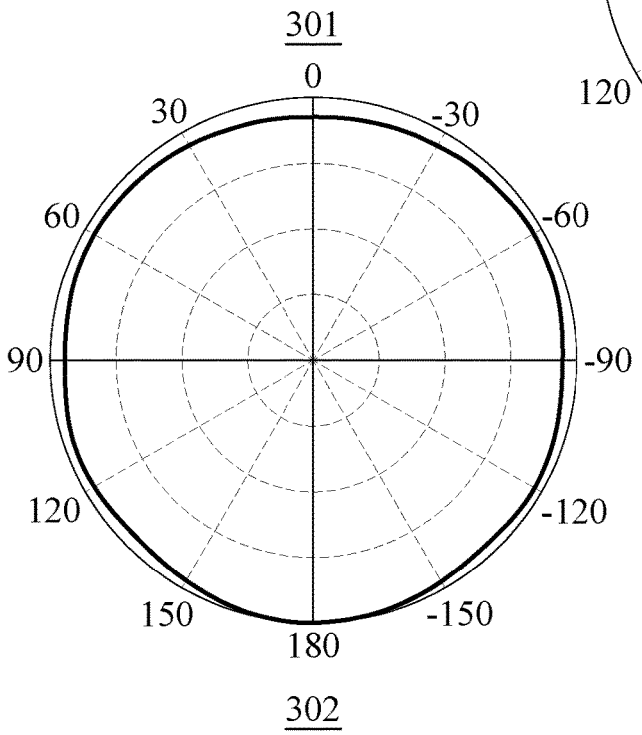
FIGS. 3B and 3C are graphs illustrating simulation results of radiation patterns of the dipole antennas of FIGS. 1A and 2A.
Figure 3C:
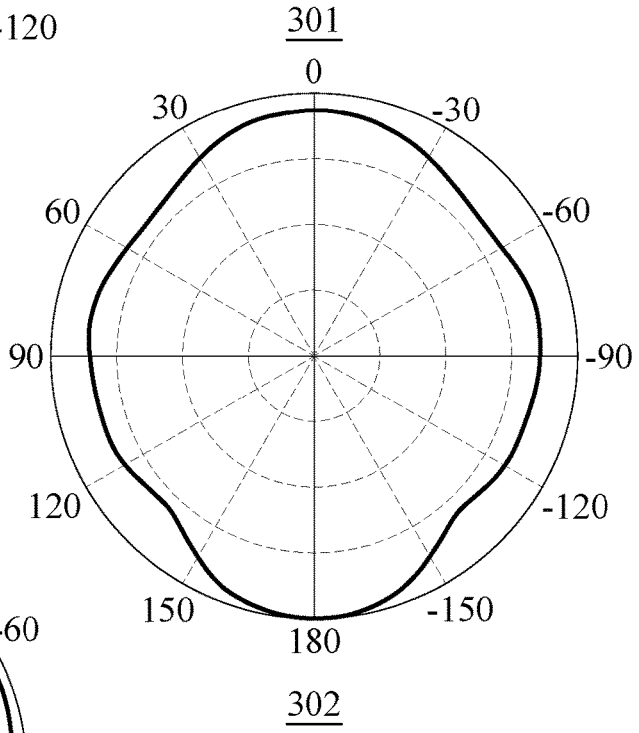

FIG. 3A is a graph illustrating a simulation result of a radiation pattern of a dipole antenna according to a related art, and FIGS. 3B and 3C are graphs illustrating simulation results of radiation patterns of the dipole antennas of FIGS. 1A and 2A.

FIGS. 3A through 3C illustrate a comparison of the simulation results of the radiation patterns of dipole antennas designed to operate in the SHF band and a frequency band higher than the SHF band, according to the related art and example embodiments. Here, the dipole antennas may be fed by a planar balun. The graphs of FIGS. 3A through 3C illustrate the radiation patterns in an azimuth direction with respect to an xy plane when a radiation element is disposed in a z direction. Also, 301 represents Farfield Gain Abs (Theta=90) of an antenna, and 302 represents a value of Phi/Degree vs. dB.

FIG. 3A illustrates the simulation result of the radiation pattern in the azimuth direction according to the related art. Referring to FIG. 3A, since an existing antenna support structure has a large volume to support both a balun and a radiation element, an omnidirectional radiation pattern of the dipole antenna is significantly distorted.

FIG. 3B illustrates the simulation result of the radiation pattern in the azimuth direction by the dipole antenna of FIGS. 1A through 1C. As shown in FIG. 3B, the radiation pattern is maintained by a structure of the balun housing 150.

FIG. 3C illustrates the simulation result of the radiation pattern in the azimuth direction by the dipole antenna of FIGS. 2A through 2C. As shown in FIG. 3C, the radiation pattern is partially distorted, but is not greatly distorted in comparison to the radiation pattern of FIG. 3A.

The components described in the example embodiments may be implemented by hardware components including, for example, at least one digital signal processor (DSP), a processor, a controller, an application-specific integrated circuit (ASIC), a programmable logic element, such as a field programmable gate array (FPGA), other electronic devices, or combinations thereof. At least some of the functions or the processes described in the example embodiments may be implemented by software, and the software may be recorded on a recording medium. The components, the functions, and the processes described in the example embodiments may be implemented by a combination of hardware and software.

The present specification includes details of a number of specific implements, but it should be understood that the details do not limit any invention or what is claimable in the specification but rather describe features of the specific example embodiment. Features described in the specification in the context of individual example embodiments may be implemented as a combination in a single example embodiment. In contrast, various features described in the specification in the context of a single example embodiment may be implemented in multiple example embodiments individually or in an appropriate sub-combination. Furthermore, the features may operate in a specific combination and may be initially described as claimed in the combination, but one or more features may be excluded from the claimed combination in some cases, and the claimed combination may be changed into a sub-combination or a modification of a sub-combination.

It should be understood that example embodiments disclosed herein are merely illustrative and are not intended to limit the scope of the disclosure. It will be apparent to those skilled in the art that various modifications of the example embodiments may be made without departing from the spirit and scope of the claims and their equivalents.

What is claimed is:

1. A dipole antenna comprising:

a first radiation element and a second radiation element respectively corresponding to poles of the dipole antenna;

at least one dipole support column configured to connect the first radiation element and the second radiation element and to fix a gap between the first radiation element and the second radiation element;

a planar balun connected to the first radiation element and the second radiation element and configured to supply balanced signals to the first radiation element and the second radiation element or to synthesize balanced signals received from the first radiation element and the second radiation element; and a balun housing coupled to the dipole support column and enclosing the planar balun.

2. The dipole antenna of claim 1, wherein the first radiation element and the second radiation element are arranged to be vertically or horizontally symmetrical to each other.

3. The dipole antenna of claim 1, wherein the first radiation element and the second radiation element have the same shape.

4. The dipole antenna of claim 1, wherein the first radiation element and the second radiation element are each formed of a metal material.

5. The dipole antenna of claim 1, wherein:

the first radiation element and the second radiation element each comprise a groove for coupling to the dipole support column, and the groove of the first radiation element and the groove of the second radiation element are formed to face each other, and the dipole support column is inserted into the groove of the first radiation element and the groove of the second radiation element, to fix the first radiation element and the second radiation element.

6. The dipole antenna of claim 1, wherein the planar balun is configured to provide balanced signals with a phase difference of 180 degrees to the first radiation element and the second radiation element.

7. The dipole antenna of claim 1, wherein the planar balun is configured to allow impedance to gradually change between the dipole antenna and a transmitter or a receiver connected to the dipole antenna.

8. The dipole antenna of claim 1, wherein the balun housing is formed of a dielectric material.

9. The dipole antenna of claim 1, wherein the balun housing comprises a plurality of fixing holes to couple the balun housing to the planar balun.

10. The dipole antenna of claim 1, wherein the balun housing comprises an input/output terminal connected to a transmitter or a receiver connected to the dipole antenna.

11. The dipole antenna of claim 1, further comprising:

a metal wire connected to each of the first radiation element and the second radiation element and configured to transfer a balanced signal between the planar balun and each of the first radiation element and the second radiation element.

12. The dipole antenna of claim 11, wherein the planar balun is connected to the metal wire and is configured to supply balanced signals to the first radiation element and the second radiation element via the metal wire or to synthesize balanced signals received from the first radiation element and the second radiation element.

13. A dipole antenna comprising:

a printed circuit board (PCB) substrate comprising at least one patch element;

a planar balun configured to supply a balanced signal to the PCB substrate or to synthesize balanced signals received from the PCB substrate;

a metal wire inserted into the PCB substrate, connected to the planar balun and configured to transfer a balanced signal between the PCB substrate and the planar balun; and a balun housing coupled to the PCB substrate and enclosing the planar balun.

14. The dipole antenna of claim 13, wherein the PCB substrate comprises a plurality of coupling holes to couple the PCB substrate to the balun housing.

15. The dipole antenna of claim 13, wherein the planar balun is configured to provide balanced signals with a phase difference of 180 degrees to the patch element.

* * * * *